US010591261B1

(12) United States Patent
Gustafson

(10) Patent No.: US 10,591,261 B1
(45) Date of Patent: Mar. 17, 2020

(54) SLIDING SHAFT FOR THROWING DART

(71) Applicant: Matthew S. Gustafson, Portage, IN (US)

(72) Inventor: Matthew S. Gustafson, Portage, IN (US)

( * ) Notice: Subject to any disclaimer, the term of this patent is extended or adjusted under 35 U.S.C. 154(b) by 0 days.

(21) Appl. No.: 16/420,742

(22) Filed: May 23, 2019

(51) Int. Cl.
*F42B 6/00* (2006.01)

(52) U.S. Cl.
CPC ..... *F42B 6/003* (2013.01)

(58) Field of Classification Search
CPC ..... F42B 6/00; F42B 6/04; A63B 65/02
See application file for complete search history.

(56) References Cited

U.S. PATENT DOCUMENTS 3,457,921 A * 7/1969 Waldeisen ..... F42B 12/54 604/130
3,995,861 A 12/1976 Clarke
4,842,285 A * 6/1989 Farler ..... F42B 6/003 473/585
4,958,838 A 9/1990 Farler
4,978,130 A 12/1990 Farler
5,009,433 A * 4/1991 Reid ..... F42B 6/003 473/582
5,419,567 A * 5/1995 Orav ..... F42B 6/003 473/585
5,642,887 A * 7/1997 Orav ..... F42B 6/003 473/586
5,899,824 A * 5/1999 Kurtz ..... F42B 6/003 403/326
5,947,851 A * 9/1999 Kicks ..... F42B 6/003 473/582
6,524,201 B2 2/2003 Fenn
6,533,688 B1 * 3/2003 Huang ..... F42B 6/003 473/570
7,241,236 B1 * 7/2007 Chen ..... F42B 6/003 473/578
8,177,668 B2 5/2012 Matsubara
8,915,807 B1 * 12/2014 Olson ..... F42B 6/04 473/578
9,435,620 B2 9/2016 Hamazaki et al.
2006/0154756 A1 * 7/2006 Shao ..... F42B 6/003 473/578

* cited by examiner

*Primary Examiner* — Eugene L Kim
*Assistant Examiner* — Christopher Glenn
(74) *Attorney, Agent, or Firm* — Cramer Patent & Design, PLLC; Aaron R. Cramer

(57) ABSTRACT

A throwing dart includes a flight movably secured about a shaft, and a tip. When the tip contacts the dartboard, the forward momentum of the flight causes the same to move forward in close proximity to the tip. The flight may be repositioned after play by pulling the same towards the end of the shaft opposite the tip. At least one (1) magnetic element is positioned to removably secure the flight in place.

19 Claims, 7 Drawing Sheets

SLIDING SHAFT FOR THROWING DART

FIELD OF THE INVENTION

The present invention relates generally to the field of sliding shafts for throwing darts.

BACKGROUND OF THE INVENTION

Darts is a fun social game that is commonly played in homes and pubs around the world. It has been around a very long time with its history dating back to the 1800's. Darts is a game of skill where accuracy is of the utmost importance. It is not uncommon to see tight groupings of three darts in a very tight space. Such groupings are difficult to obtain as the flights (fin section) of previously thrown darts may be blocking access to the desired point. Many dart players turn to the use of darts with short shafts to increase the open area of possible access paths.

Unfortunately, short shafts often lead to unstable travel through the air. Accordingly, there exists a need for a means by which the accuracy of thrown darts can be increased by the use of long shafts, but without their tendency to block travel paths for following darts that are thrown. The development of the playing dart with movable flight 10 fulfills this need.

SUMMARY OF THE INVENTION

The principles of the present invention provide for a playing dart, comprising a flight having a plurality of fins to steady the playing dart during travel, a shaft which is located immediately forward of the flight, a receiver, and a barrel—the barrel having a knurled exterior to aid in holding the playing dart. The shaft connects the flight to the receiver. The dart also comprises a tip located at a most forward portion of the playing dart capable of penetrating a playing surface. Only upon impact of the tip does the shaft and its affixed magnet begin to move along a travel path and has magnetically engaged a second washer to effectively reduce an overall length of the playing dart removing a portion of the shaft normally visible on an exterior of the playing dart. Additionally, a momentum force of the shaft, which includes a mass of the affixed magnet, the shaft and the fins, is adequate to overcome a second washer force between the affixed magnet and the first washer.

The fins may be affixed to the shaft with aid of an indentation and thus form the flight. The flight may be made of material selected from the group consisting of plastic polymers, nylon, or foil. The shaft length may affect the stability of the playing dart in flight. An opposite end of the shaft may be permanently affixed with the affixed magnet in the shape of a square toroid. Located immediately aft of the affixed magnet may be a first washer in the shape of a square toroid. The shaft may be free to slide within an opening of the first washer and is held in place via magnetism only. The first washer may be permanently affixed to a plastic sleeve which allows for reduced friction and easy movement of the first washer. The playing dart may also comprise the second washer located at a forward end of the plastic sleeve.

The shaft may be made of material selected from the group consisting of aluminum, plastic, nylon, or titanium. The interior of the receiver may be provided with an open cylindrical area through which the affixed magnet and the shaft move as a piston. The barrel may be made of material selected from the group consisting of nickel, tungsten, or steel while the receiver may be selected from the group consisting of plastic, brass, nickel-silver, or tungsten. The playing surface may be a dart board while the tip may be made of steel or plastic.

Upon retrieval of the throwing dart from the playing surface, a player would manually reset the throwing dart by moving the shaft in relation to the receiver along the travel path opposite that as defined by the travel with the affixed magnet disengaging the second washer and engaging the first washer, thus resetting the throwing dart in a rigid manner for another throwing attempt. A forward momentum of the affixed magnet, the shaft and the fins may increase penetration into the playing surface, thus lessening a chance of the playing dart bouncing out, falling, out, or being knocked out by following darts.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
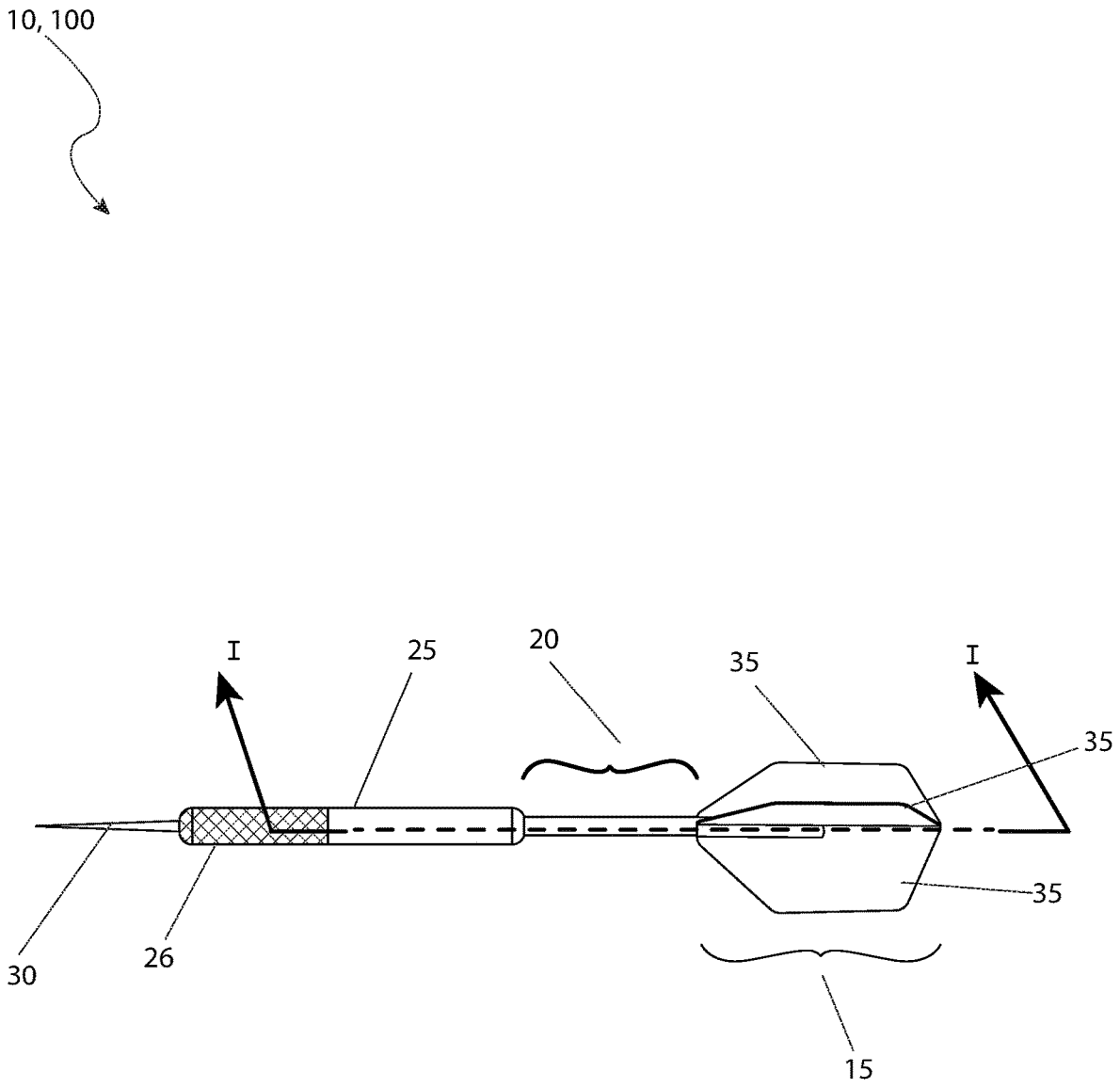
FIG. 1 is a side view of a playing dart 10, 100, with the shaft 20 in an extended position, according to both a preferred and an alternate embodiment of the present invention.

10 playing dart
11 conventional playing dart
15 flight
20 shaft
24 weep hole
25 receiver
26 barrel
27*a* first fastener half
27*b* second fastener half
30 tip
35 fins
40 split end
45 magnet
46 slide element

50 first washer
55 open cylindrical area
60 plastic sleeve
62 second washer
65 travel path "i"
70 dartboard
75 open access area
100 alternate playing dart

DESCRIPTION OF THE PREFERRED EMBODIMENTS

The best mode for carrying out the invention is presented in terms of its preferred and alternate embodiments, herein depicted within FIGS. 1 through 4*b*. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

Referring now to FIG. 1, a side view of a playing dart 10, 100 with a shaft 20 in an extended position, according to both a preferred and an alternate embodiment of the present invention is disclosed. The playing dart (herein also described as the "device") 10, 100, appears under initial examination to appear as a conventional dart 11. In addition to the flight 15 at the rearward portion of the device 10, other components include the shaft 20, a receiver 25, a barrel 26, and a tip 30.

The flight 15 is provided with multiple fins 35 to steady the playing dart 10, 100 during flight after it is thrown by a player. The shaft 20 is located immediately forward of the flight 15 and connects the flight 15 to the receiver 25. It is noted that the shaft 20 may vary in length when comparing different styles of conventional playing darts, as the length of the shaft 20 affect the stability of darts in flight. A longer shaft 20 may help with aerodynamic properties but can lead to a wobbling effect in the air. Additionally, a long shaft 20 may lead to a "crowded" dartboard 70 area, making it difficult for following darts 10, 100 to land in a tight grouping. The receiver 25 is the middle section and is removably attachable to the barrel 26. Preferably, a portion of the barrel 26 is typically formed with a knurled exterior to aid in holding the device 10, 100. The barrel 26 can have a length equal or nearly identical to the receiver 25 but is typically approximately half the length thereof. The barrel 26 is most commonly manufactured out of a separate material than the receiver 25 to aid in gripping. Such a material can be nickel, tungsten, steel, or similar. In a preferred embodiment, the first end of the receiver 25 has a first fastener half 27*a* that is capable of mating with a second fastener half 27*b* located at a second end of the barrel 26. The first and second fastener halves 27*a*, 27*b* are most typically threaded features.

The tip 30 is located at the first end of the barrel 26 and is the actual component that penetrates a playing surface, typically a dartboard 70. The tip 30 may be formed of either steel or plastic with either material capable of being utilized with the teachings of the present invention. The receiver 25 may be made of plastic, brass, nickel-silver or tungsten. The shaft 20 may be made of aluminum, plastic, nylon or titanium. The flight 15 may be made of plastic polymers, nylon, or foil. However, it is noted that any material of any component of the device 10, 100 is not intended to be a limiting factor of the present invention. It is noted that FIG. 1 discloses a device 10, 100 with a long shaft 20, which is present before the device 10, 100 is thrown, and is also present during flight of the device 10, 100 such that stability during flight is enhanced.

Figure 2:
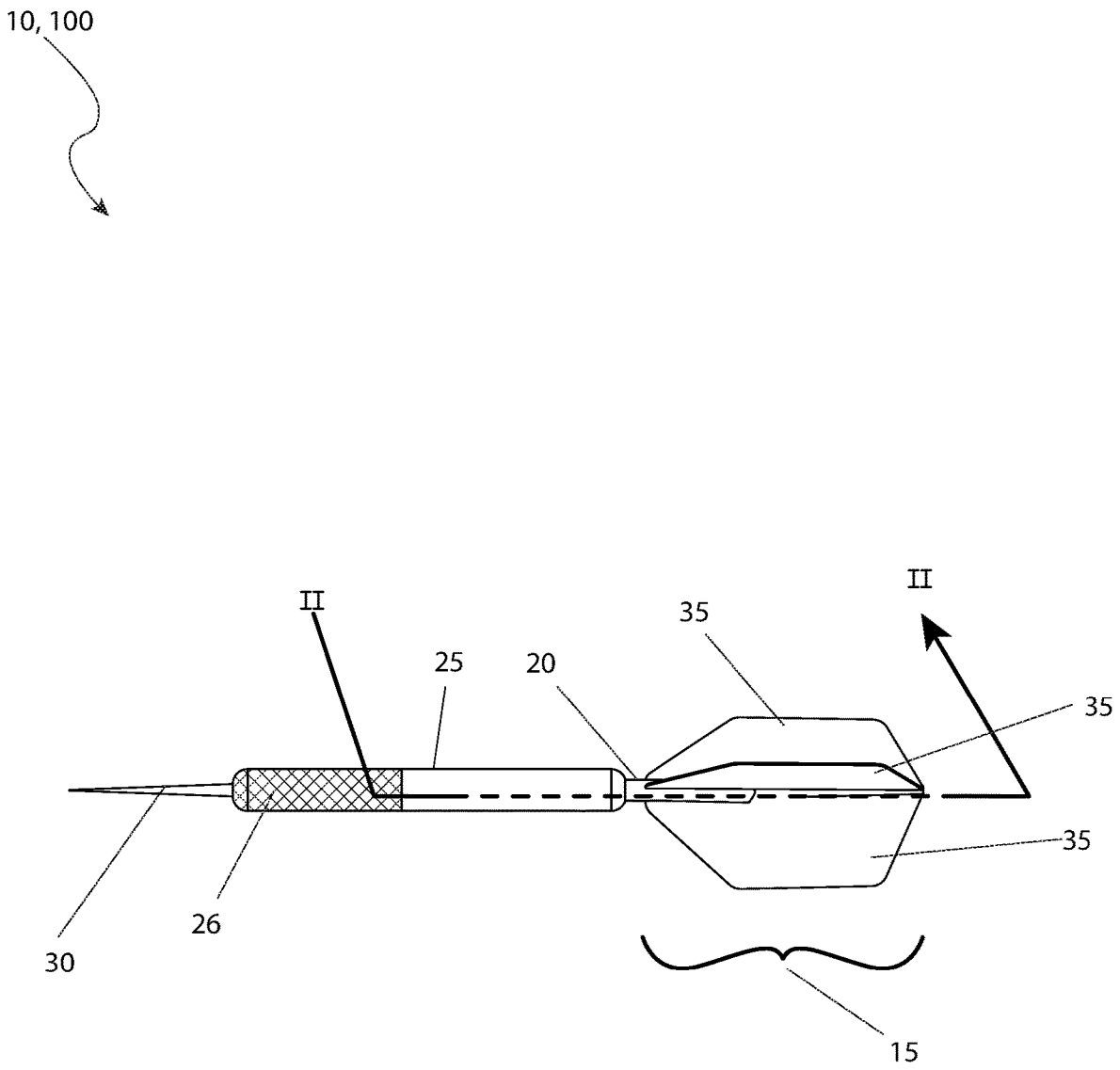
FIG. 2 is a side view of the playing dart 10, 100, with the shaft 20 in a retracted position, according to both the preferred and the alternate embodiment of the present invention.

Referring next to FIG. 2, which illustrates a side view of the device 10, 100 with the shaft 20 in a retracted position, according to the preferred embodiment of the present invention is depicted. All of the previously described components of the device 10, 100, such as the tip 30, the receiver 25, and the fins 35 of the flight 15 with the exception of the shaft 20. The shaft 20 is now presented as contained within the receiver 25. Further details on this configuration will be described in greater detail herein below. It is noted that FIG. 2 discloses a device 10, 100 with a short (or absent) shaft 20, which is absent after the device 10, 100 is thrown. This configuration is as would be seen immediately after the device 10, 100 strikes the dartboard 70.

Figure 3A:
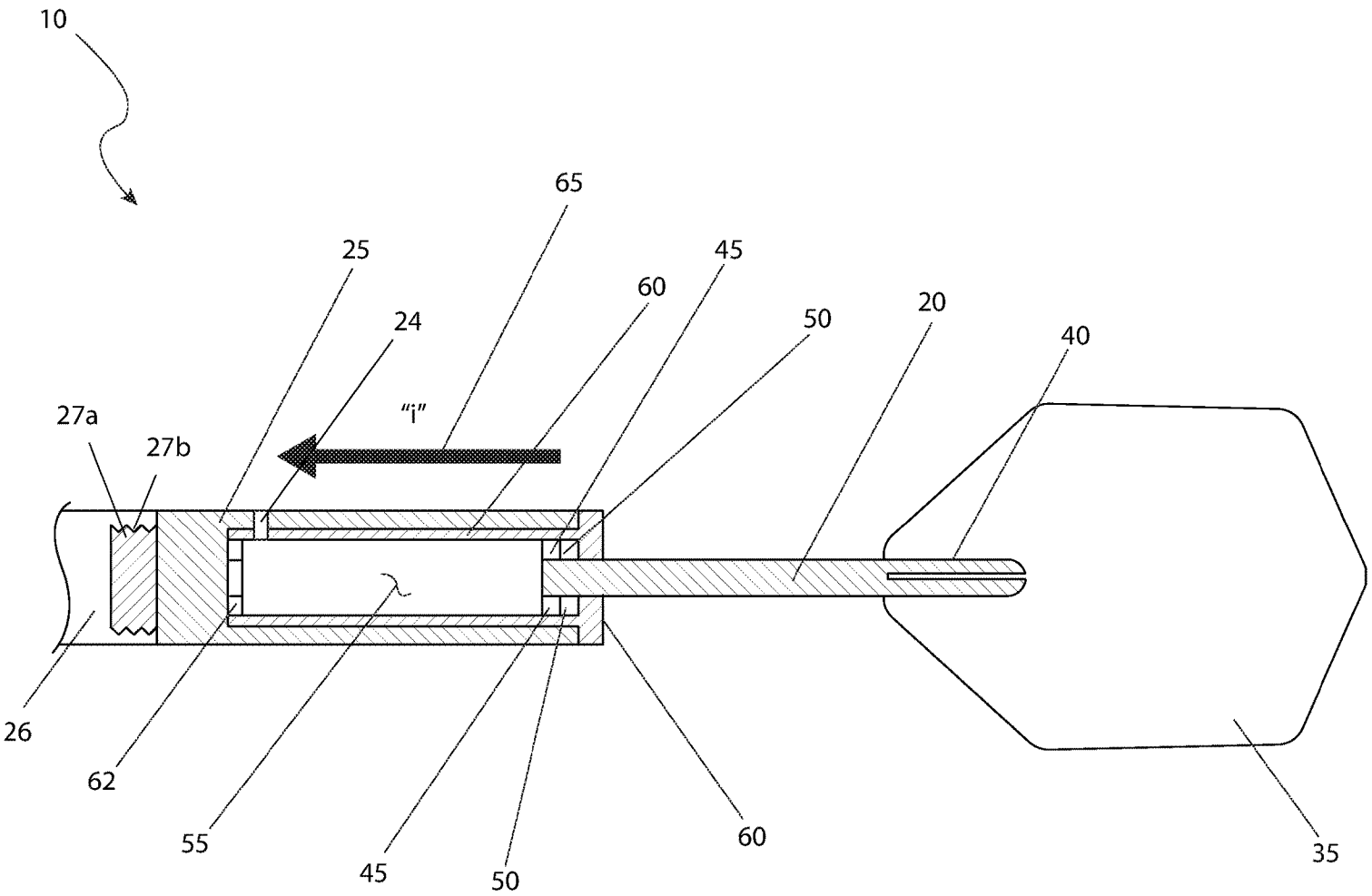
FIG. 3*a* is a sectional view of the playing dart 10, as seen along a line I-I, as shown in FIG. 1, according to the preferred embodiment of the present invention.

Referring now to FIG. 3*a*, which illustrates a sectional view of the device 10 as seen along a line I-I as shown in FIG. 1, according to the preferred embodiment of the present invention is shown. The fins 35 of the flight 15 are attached onto the shaft 20 by inserting the forward portions of the fins 35 within the split end 40 of the shaft 20. The opposite end of the shaft 20 is permanently affixed with a magnet 45, preferably in the shape of a square toroid. Located immediately aft of the magnet 45 is a first washer 50, also magnetic and in the shape of a square toroid. However, the shaft 20 is free to slide within the opening of the first washer 50 and is held in place via magnetism only. The interior of the receiver 25 is provided with an open cylindrical area 55 through which the magnet 45 and shaft 20 can move in much the same manner as a piston. A plastic sleeve 60 has a first end affixed to a second end of the receiver 25 and extends within the open cylindrical area 55 and allows the shaft 20 to slidably engage therewith. The first washer 50 is permanently affixed to the plastic sleeve 60 such that it resides within the open cylindrical area. The plastic sleeve 60 allows for reduced friction and easy movement of the first washer 50. A second washer 62, with the same configuration and magnetic properties as the first washer 50, is located at the forward end of the plastic sleeve 60, also within the open cylindrical area 55. A weep hole 24 is located adjacent a first end of the receiver 25 as provide environmental communication for the open cylindrical area 55 and the outside of the device 10. This provides a way to equalize the pressure within the open cylindrical area 55 when the shaft 20 travels therewithin. The weep hole 24 is located in such a manner so as to not be covered by the second washer 62 or magnet 45 when the shaft 20 is fully retracted within the open cylindrical area 55. This configuration with the magnet 45 engaged upon the first washer 50 is during initial handling of the device 10, throwing of the device 10 and travel through the air of the device 10. Only upon impact of the tip 30 (as shown in FIG. 1) does the shaft 20 and its affixed magnet 45 begin to move along a travel path "i" 65.

Figure 3B:
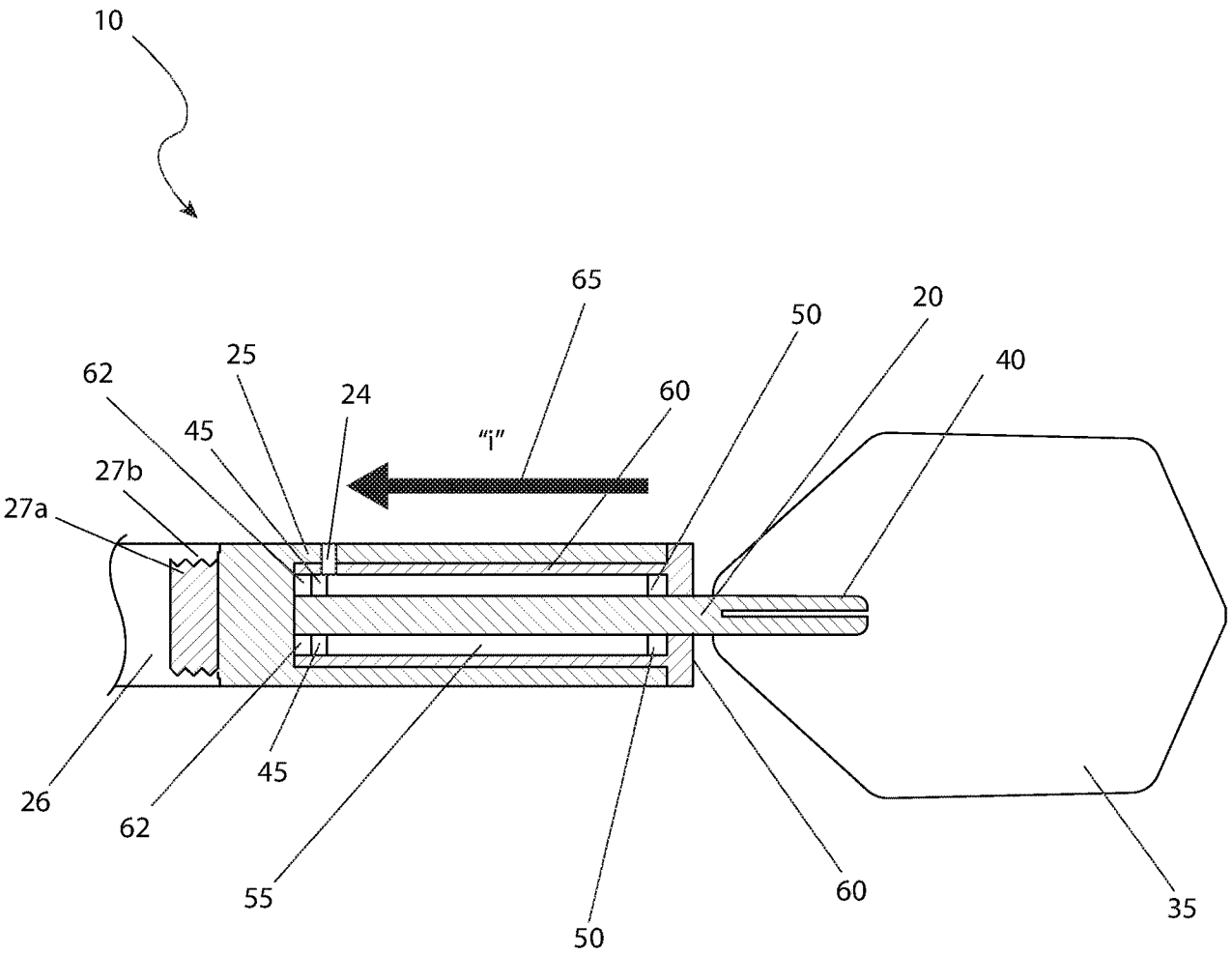
FIG. 3*b* is a sectional view of the playing dart 10, as seen along a line II-II, as shown in FIG. 2, according to the preferred embodiment of the present invention.

Referring next to FIG. 3*b*, which illustrates a sectional view of the device 10 as seen along a line II-II as shown in FIG. 2, according to the preferred embodiment of the present invention is disclosed. This figure clearly shows the relationship of the shaft 20 within the confines of the receiver 25 as would be seen immediately after the device 10 impacts a dartboard 70. As before, the fins 35 remain attached onto the split end 40 of the shaft 20. The opposite end of the shaft 20 remains permanently affixed with the magnet 45. The first washer 50 remains affixed to the aft portion of the plastic sleeve 60. The magnet 45 has moved within the open cylindrical area 55 along the travel path "i" 65 and has magnetically engaged the second washer 62 to effectively reduce the overall length of the device 10 by removing the portion of the shaft 20 normally visible on the exterior of the device 10. It is noted that the momentum force of the shaft 20 including the mass of the magnet 45, the shaft 20 and the fins 35 is adequate to overcome the magnetic force between the magnet 45 and the first washer 50. Upon retrieval of the device 10, 100 from the dartboard 70, the user would manually reset the device 10 by moving the shaft 20 in relation to the receiver 25 along a travel path opposite that as defined by the travel path "i" 65 with the magnet 45 disengaging the second washer 62 and engaging the first washer 50, thus resetting the device 10 in a rigid manner for another throwing attempt. Additionally, it is envisioned that the forward momentum of the magnet 45, the shaft 20 and the fins 35 will increase penetration into the dartboard 70, thus lessening the chance of the device 10 bouncing out, falling, out, or being knocked out by following darts. While beneficial for all types of device 10, it is envisioned that this characteristic would be most beneficial with device 10 using tip 30 (as shown in FIGS. 1 and 2) made of steel.

Figure 4A:
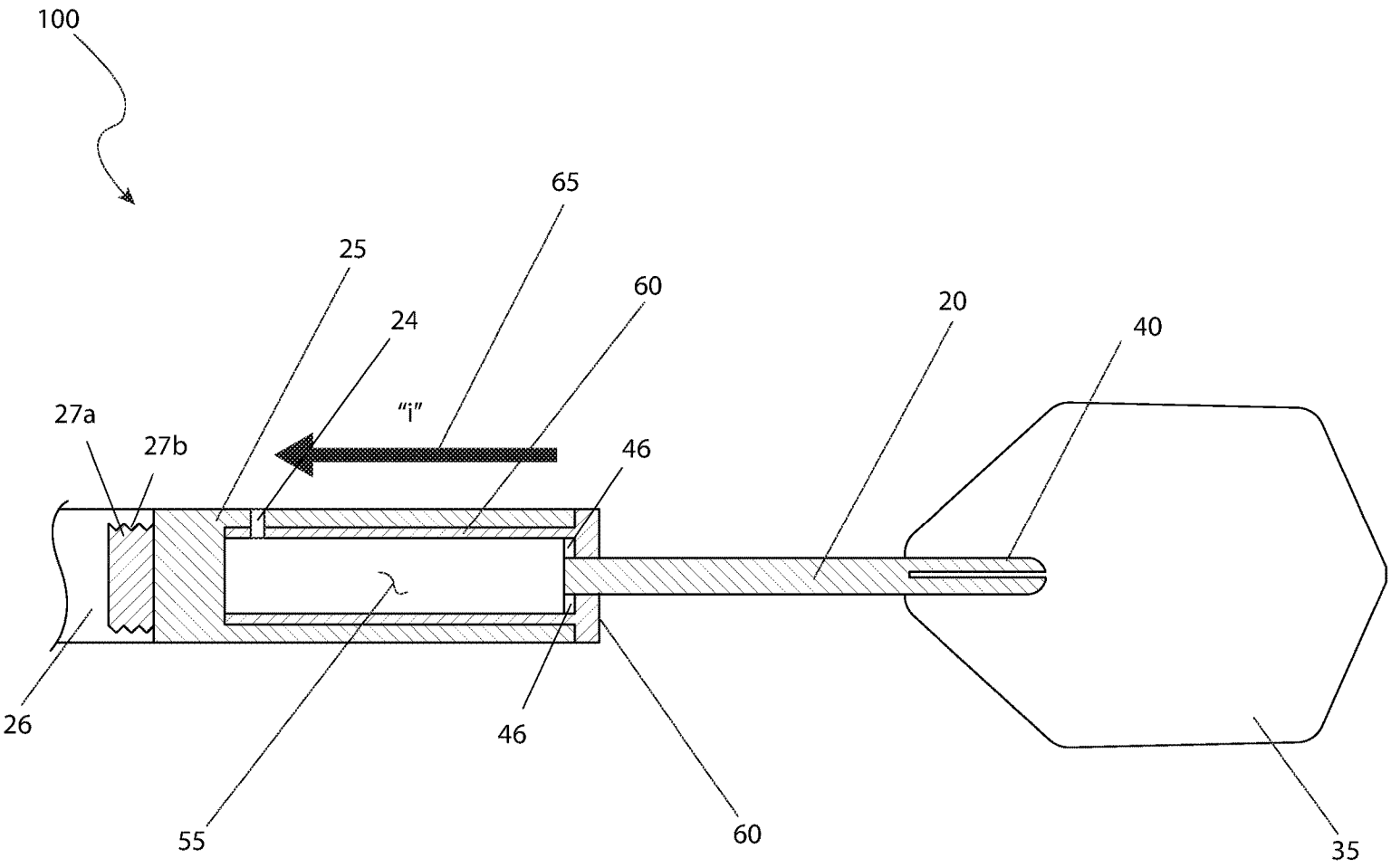
FIG. 4*a* is a sectional view of the playing dart 100, as seen along a line I-I, as shown in FIG. 1, according to the alternate embodiment of the present invention.
Figure 4B:
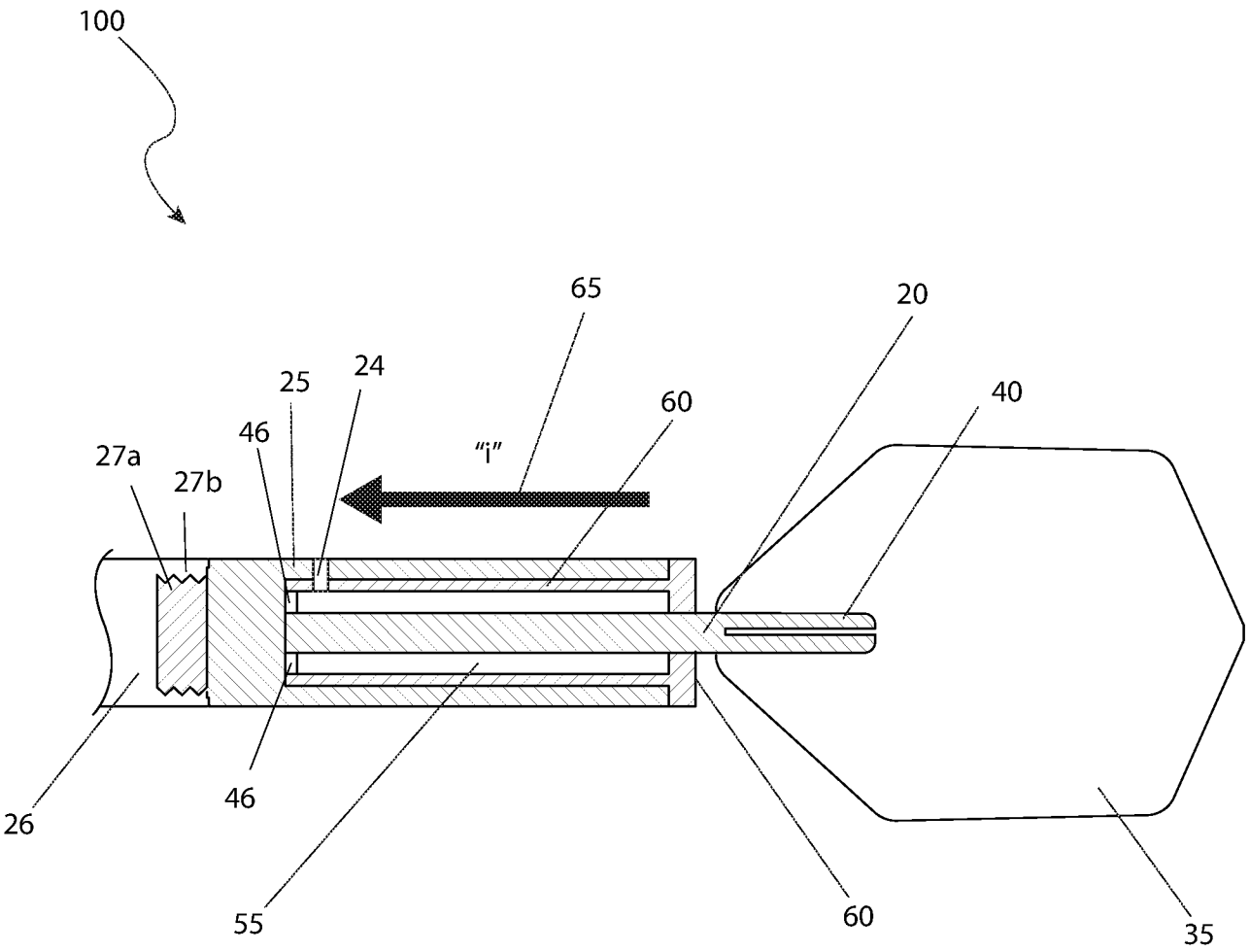
FIG. 4*b* is a sectional view of the playing dart 100, as seen along a line II-II, as shown in FIG. 2, according to the alternate embodiment of the present invention.

Referring now to FIGS. 4*a* and 4*b*, which illustrate a sectional view of the device 100 as seen along the line I-I as shown in FIG. 1, and a sectional view of the device 100 as seen along a line II-II, as shown in FIG. 2, according to the alternate embodiment of the present invention is disclosed. The alternate device 100 is nearly identical in every way to the preferred device 10, except for the absence of the magnet 45, first washer 50, and second washer 62. A slide element 46, nearly or exactly identical in shape and size as the magnet 45 of the preferred device 10, slidably engages the inner surface of the plastic sleeve 60. This means that the shaft 20 moves freely within the plastic sleeve 60 of the open cylindrical area 55 of the receiver 25. It is envisioned that the shaft 20 will not move until it strikes the dartboard 70, wherein the shaft 20 will travel along path "i" 65 in much the same manner as in the preferred device 10. The weep hole 24 in the alternate device 100 performs in the same manner as the preferred device 10, and is located such that it is not covered by the sliding element 46 when the shaft 20 is fully retracted within the open cylindrical area 55.

Figure 5A:
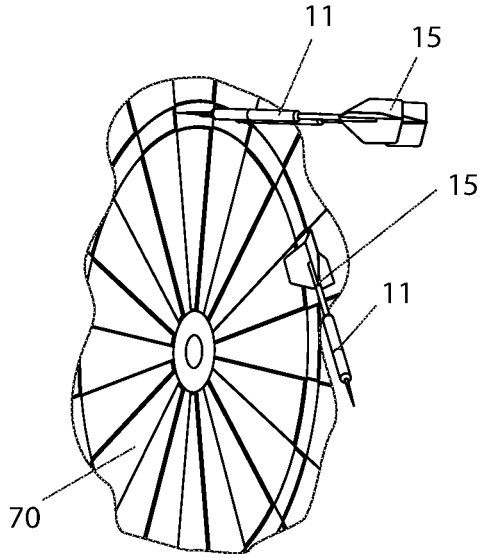
FIG. 5*a* is a perspective view of a conventional playing dart 11, shown in a utilized state on a dartboard 70, where the flight 15 is not linearly movable, according to the preferred embodiment of the present invention; and, FIG. 5*b* is a perspective view of the playing dart 10, 100, shown in a utilized state on a dart board 70, according to both the preferred and the alternate embodiment of the present invention.
Figure 5B:
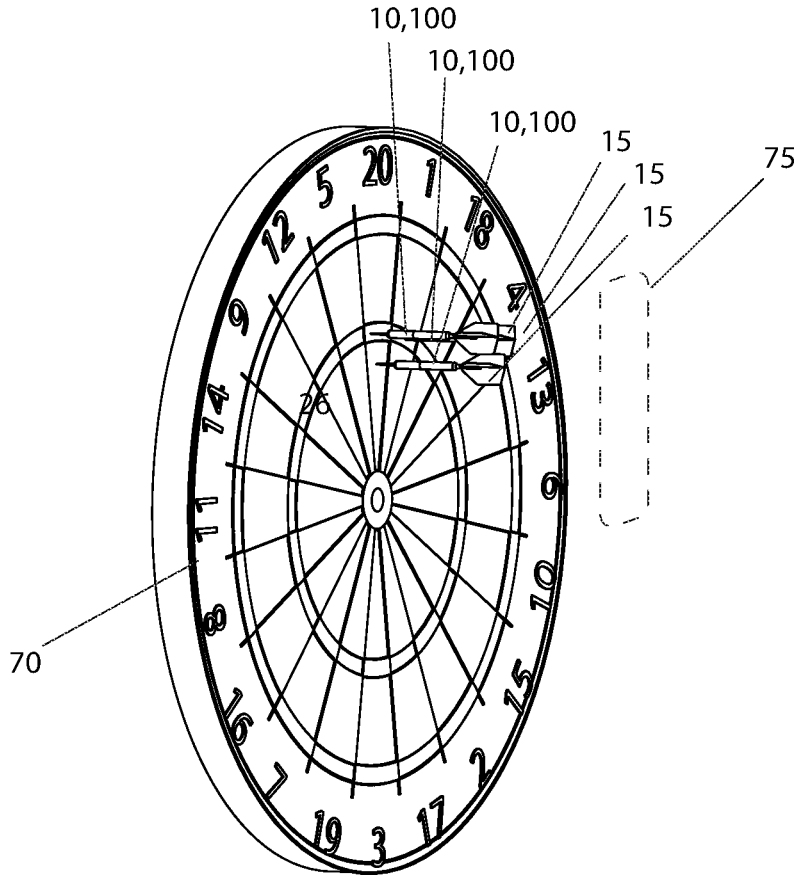

Referring to FIGS. 5*a* and 5*b*, which illustrates a perspective views of the device 10, 100 as well as a conventional dart 11, shown in a utilized state on a dartboard 70. FIG. 5*a* depicts a plurality of conventional darts 11 being thrown towards a dartboard 70. More specifically, it is shown that after a first conventional playing dart 11 contacts the dartboard 17, a subsequent throwing of another conventional playing dart 11 contacts the flight 15 of the first conventional playing dart 11 and is blocked from contacting the dartboard 70 and resulting in no points for the thrower. In a typical game of darts, accurate and precise throws are common in very tight spaces (called "groupings") and conventional playing darts 11 that do not have linearly movable flights 15 can result in the aforementioned non-pointing event.

Referring now to FIG. 5*b*, multiple devices 10, 100 are shown in an engaged status with the dartboard 70 with their shaft 20 in a forward or retracted position as shown in FIG. 2. This configuration produces an open access area 75 for following devices 10, 100 or even conventional darts 11. The open access area 75 would not be available in the case of conventional darts 11. As such, the use of the device 10, 100 allows for closer or tighter groupings, higher scores and thus improved playing ability.

The preferred embodiment of the present invention can be utilized by the common user in a simple and effortless manner with little or no training. It is envisioned that the device 10, 100 would be constructed in general accordance with FIGS. 1 through 4*b*. The user would procure the device 10, 100 through normal procurement channels while paying particular attention to various normal dart characteristics such as weight, overall length, color, material of construction, and the like.

After procurement and prior to utilization, the device 10, 100 would be prepared in the following manner: the user would ensure that the device 10, 100 is ready to be thrown by holding the receiver 25 in one (1) hand (typically by the barrel 26) and slightly tugging the flight 15 and shaft 20 in a direction opposite that of the travel path "i" 65 with the other. In the instance where the preferred device 10 is used, this would ensure that the magnet 45 is engaged upon the first washer 50 via magnetic force.

During utilization of the device 10, 100, the following procedure would be initiated: the device 10, 100 would be thrown in a conventional manner via the barrel 26 using the intrinsic skill of the player; upon impact with the dartboard 70, the shaft 20 and the flight 15 will move forward within the open cylindrical area 55 of the plastic sleeve 60 to its full extent of its travel. In the instance where the preferred device 10 is used, the magnet 45 engages the second washer 62. In instances where either device 10, 100 is used, the open access area 75 is produced allowing following device 10, 100 to more easily obtain a tight grouping.

After use of the device 10, 100, it is removed from the open access area 75 by pulling it out via its receiver 25 or barrel 26; the user would then hold the receiver 25 or barrel 26 in one (1) hand and slightly tug the flight 15 and shaft 20 in a direction opposite that of the travel path "i" 65 with the other thus resetting it for use in a cyclical manner.

The use of the device 10, 100 is envisioned to help all levels of players from beginner to professional improve their game.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A sliding shaft for a playing dart, comprising: a shaft having an affixed magnet and located immediately forward of a flight; a receiver; and, a barrel, said barrel having a knurled exterior to aid in holding a playing dart, said shaft connects said flight to said receiver; wherein only upon impact of a tip, said tip being located at a most forward portion of said playing dart and configured to penetrate a playing surface, does said shaft and its affixed magnet begin to move along a travel path and has magnetically engaged a second washer to effectively reduce an overall length of said playing dart removing a portion of said shaft normally visible on an exterior of said playing dart; and wherein a momentum force of said shaft including a mass of said affixed magnet, said shaft and fins is adequate to overcome a magnetic force between said affixed magnet and a first washer.

2. The playing dart according to claim 1, wherein a plurality of fins are affixed to said shaft with aid of an indentation and thus form said flight.

3. The playing dart according to claim 1, wherein said flight is made of material selected from a group consisting of plastic polymers, nylon, or foil.

4. The playing dart according to claim 1, wherein a shaft length affects stability of said playing dart during travel.

5. The playing dart according to claim 1, wherein an opposite end of said shaft is permanently affixed with said affixed magnet in a shape of a square toroid.

6. The playing dart according to claim 5, wherein located immediately aft of said affixed magnet is said first washer in a shape of a square toroid.

7. The playing dart according to claim 1, wherein said shaft is free to slide within an opening of said first washer and is held in place via magnetism only.

8. The playing dart according to claim 1, wherein said first washer is permanently affixed to a plastic sleeve which allows for reduced friction and easy movement of said first washer.

9. The playing dart according to claim 8, further comprising said second washer located at a forward end of said plastic sleeve.

10. The playing dart according to claim 1, wherein said shaft is made of material selected from a group consisting of aluminum, plastic, nylon, or titanium.

11. The playing dart according to claim 1, wherein said shaft is contained within said receiver.

12. The playing dart according to claim 1, wherein interior of said receiver is provided with an open cylindrical area through which said affixed magnet and said shaft move as a piston.

13. The playing dart according to claim 1, wherein said barrel is made of material selected from a group consisting of nickel, tungsten, or steel.

14. The playing dart according to claim 1, wherein said receiver is selected from a group consisting of plastic, brass, nickel-silver, or tungsten.

15. The playing dart according to claim 1, wherein said playing surface is a dart board.

16. The playing dart according to claim 1, wherein said tip is made of steel.

17. The playing dart according to claim 1, wherein said tip is made of plastic.

18. The playing dart according to claim 1, wherein upon retrieval of said playing dart from said playing surface, a player would manually reset said playing dart by moving said shaft in relation to said receiver along said travel path opposite that as defined by said travel with said affixed magnet disengaging said second washer and engaging said first washer, thus resetting said throwing dart in a rigid manner for another throwing attempt.

19. The playing dart according to claim 1, wherein a forward momentum of said affixed magnet, said shaft and said fins will increase penetration into said playing surface, thus lessening a chance of said playing dart bouncing out, falling, out, or being knocked out by following darts.

* * * * *